US005310254A

United States Patent [19]

Dallaire

[11] Patent Number: 5,310,254

[45] Date of Patent: May 10, 1994

[54] LOCKER PROVIDING AN EFFICIENT VENTILATION OF ITS CONTENT

[75] Inventor: Michel Dallaire, Montréal, Canada

[73] Assignee: Decolam, Inc., Quebec, Canada

[21] Appl. No.: 799,382

[22] Filed: Nov. 27, 1991

[51] Int. Cl.[5] ..... A47B 97/00

[52] U.S. Cl. ..... 312/213; 454/193

[58] Field of Search ..... 312/213, 206; 454/193, 454/195

[56] References Cited

U.S. PATENT DOCUMENTS

| | | | |
|---|---|---|---|
| 1,842,286 | 1/1932 | Potter . | |
| 2,172,266 | 9/1939 | Whitaker . | |
| 2,794,325 | 6/1957 | Shearer | 454/193 |
| 3,133,772 | 5/1964 | Brandes et al. . | |
| 3,210,456 | 10/1965 | Skubal | 312/213 |
| 3,231,322 | 1/1966 | Shaw . | |
| 3,347,145 | 10/1967 | Steelman | 454/193 |
| 3,687,052 | 8/1972 | Schonberg | 454/195 |
| 3,819,246 | 6/1974 | List . | |

FOREIGN PATENT DOCUMENTS

| | | | |
|---|---|---|---|
| 0076666 | 8/1917 | Switzerland | 312/213 |

*Primary Examiner*—Kenneth J. Dorner
*Assistant Examiner*—Gerald Anderson
*Attorney, Agent, or Firm*—Collard & Roe

[57] ABSTRACT

The locker comprises a back wall, a top wall, a bottom wall, a front wall and two side walls to form a chamber. The front wall is provided with a door by which a user can have access to the chamber. The front wall forms with the side walls two lateral vertical edges that are respectively provided with two wire meshes along at least a portion of their length whereby air circulation inside the chamber can be provided by means of the two wire meshes.

5 Claims, 2 Drawing Sheets

LOCKER PROVIDING AN EFFICIENT VENTILATION OF ITS CONTENT

FIELD OF THE INVENTION

The present invention relates to lockers and has to do more particularly with lockers where an adeqate air circulation is needed.

PRIOR ART

Known in the art, there is the U.S. Pat. No. 3,133,772 by A. BRANDES et. al. in which there is described standard lockers provided with front narrow louver openings by which a certain ventilation of the inside portion of the locker is obtained. One drawback with this locker is that the ventilation that is obtained is not sufficient for certain applications.

Also known in the art, there is the U.S. Pat. No. 3,231,322 of R. E. SHAW in which there is described Pilfer-proof storage rack and containers. Very good ventilation is obtained with such containers. The drawback with these containers is that the content of the container is always visible which, for many applications such as in gymnasiums, is not wanted.

Also known in the art are the following patents: U.S. Pat. Nos. 1,842,286 (C. H. POTTER), 2,172,266 (E. H. WHITAKER) and 3,819,246 (H. A. LIST). None of those patents can provide a locker where its content is not visible from the outside, with an efficient ventilation.

An object of the present invention is to provide a locker where the content of the locker is not visible from the outside, and where a very efficient air circulation of the locker interior is obtained.

SUMMARY OF THE INVENTION

According to the present invention, there is provided a locker comprising a back wall, a top wall, a bottom wall, a front wall and two side wall, to form a chamber, said front wall being provided with a door by which a user can have access to said chamber, said front wall forming with said side walls two lateral vertical edges that are respectively provided with two ventilating means along at least a portion of their length whereby air circulation inside said chamber can be provided by means of said two ventilating means.

The objects, advantages and features of the present invention will become more apparent upon reading of the following non restrictive description of preferred embodiments thereof, given with reference to the accompanying drawings.

DETAILED DESCRIPTION OF THE PREFERRED EMBODIMENT

Figure 1:
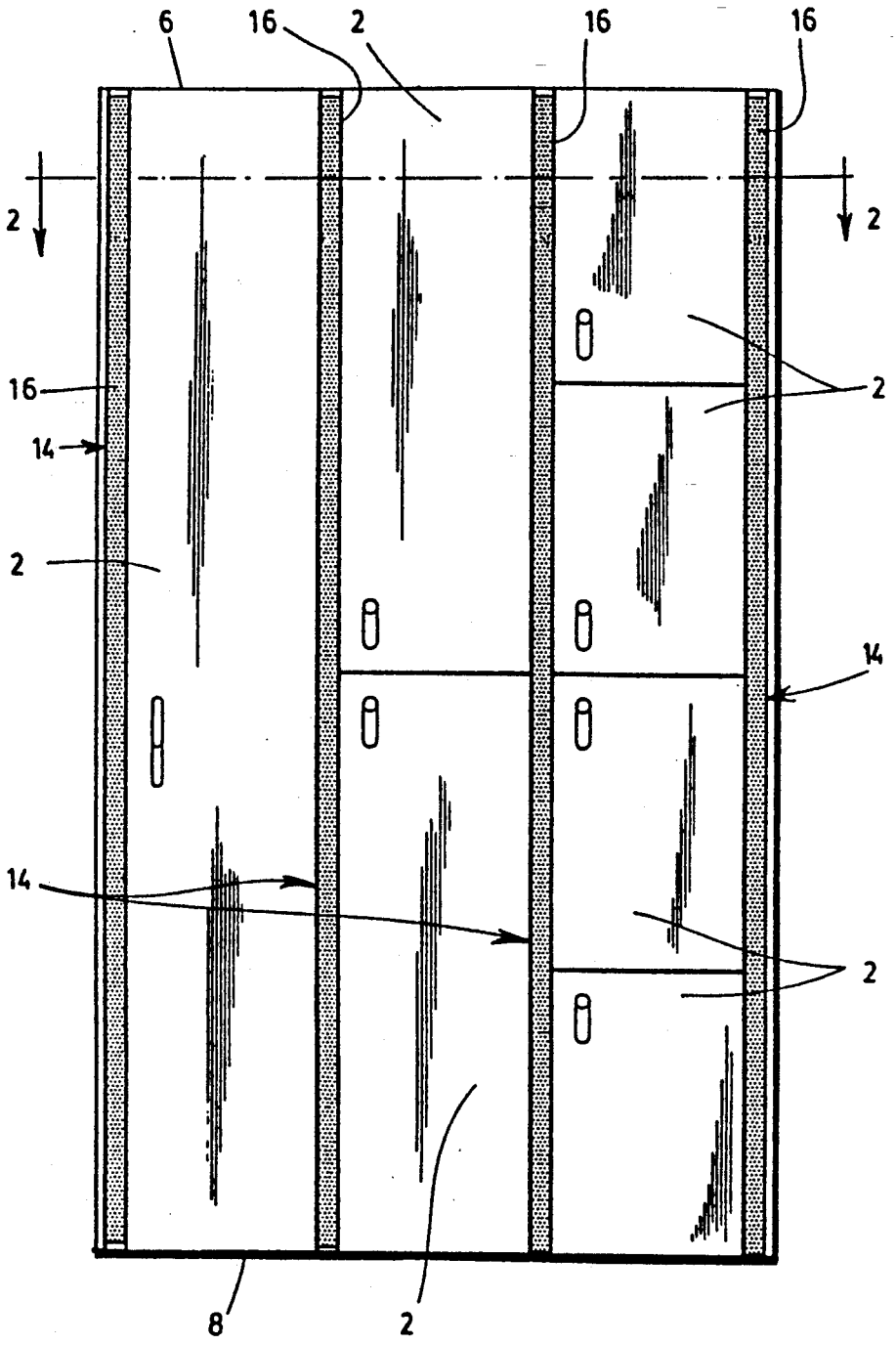
FIG. 1 is a front view of several adjacent lockers according to the present invention.

Referring now to FIGS. 1 and 21 there is shown several lockers 2 wherein each locker 2 comprises a back wall 4, a top wall 6, a bottom wall 8, a front wall 10 and two side walls 11 to form a chamber 12. The front wall 10 is provided with a door by which a user can have access to the chamber 12. The front wall 10 forms with the side walls 11 two lateral vertical edges 14 that are provided with wire meshes along their length whereby air circulation inside the chamber 12 is provided by means of the two wire meshes of each locker. Please note that it is not necessary that each of the wire meshes be provided along all the length of the lateral edges, sometimes, it is sufficient to provide only a portion of the lateral edges with a wire mesh. As it can be seen from FIGS. 1 and 2, the lockers have at least one of their side walls and one of their wire meshes that are common.

Figure 2:
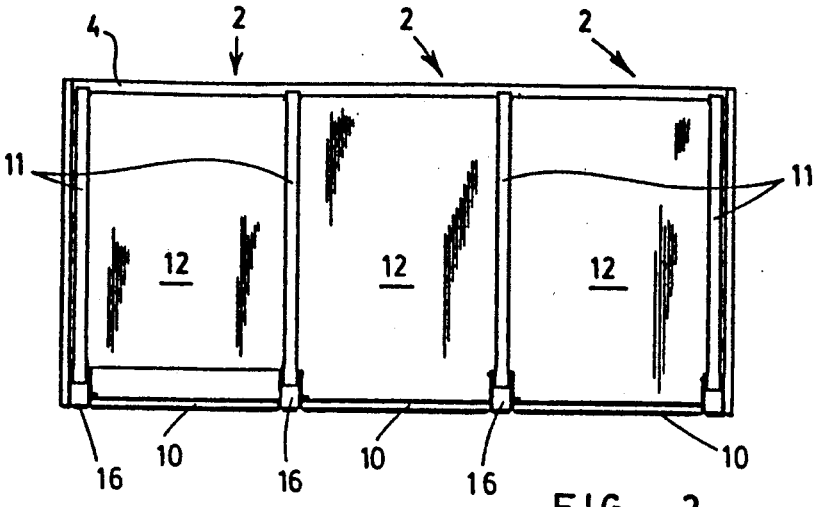
FIG. 2 is a cross-sectional view of the lockers shown in FIG. 1 along lines 2—2.
Figure 3:
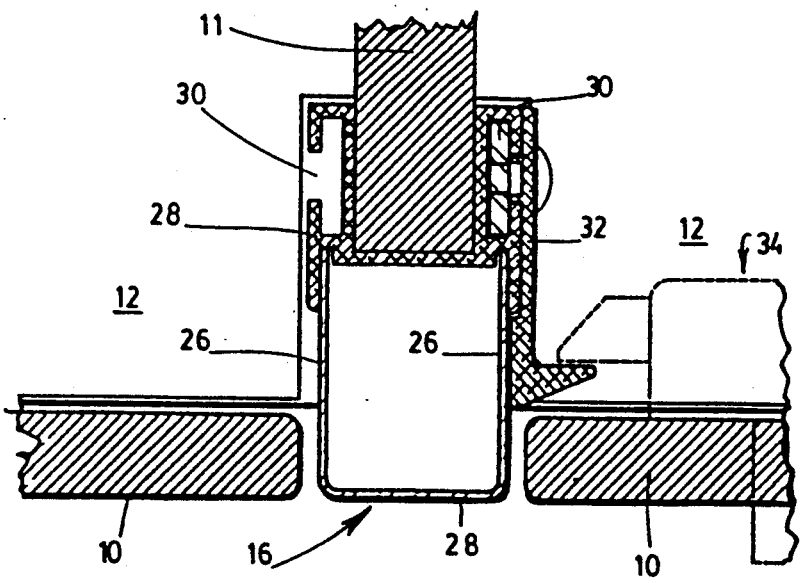
FIG. 3 is an enlarged illustration of a portion of the view shown in FIG. 2.

Referring now to FIG. 3, which is an enlarged view of a portion of FIG. 2, it can be seen that each of the common wire meshes is an elongated member of U-shaped cross section having its side sections 26 facing respectively each of the two adjacent chambers 12, and its linking section 28 interposed between the two adjacent front walls 10.

Each of the common wire meshes is mechanically connected to the corresponding common side wall 11 by means of a rigid element 28 having a U-shaped rear side adapted to receive the edge of the common side wall 11, and a front side provided with lateral recesses adapted to receive respectively edges of the common wire mesh 16. Also, the rigid element 28 is provided with lateral recesses 30 by which the locking member 32 is fixed onto the rigid element to cooperate with the locking device 34 fixed on the corresponding door.

The walls of the locker can be made of different material, but it has been found convenient that these walls be made of plastic laminated panels, Also, it has been found convenient that the wire meshes be made of cold laminated steel, of galvanized steel or of stainless steel. The rigid element 28 is made of aluminum 6063-T5 by extrusion.

Although the present invention has been described hereinabove by way of a preferred embodiment thereof it should be pointed out that any modification to this preferred embodiment, within the scope of the appended claims, is not deemed to change or alter the nature and scope of the present invention.

The embodiments of the invention in which an exclusive property or privilege is claimed are defined as follows:

1. A locker comprising a back wall, a top wall, a front wall and two side walls to form a chamber, said front wall being provided with a door by which a user can have access to said chamber, said front wall forming with said side walls two lateral vertical edges having a length, said side walls respectively provided with two ventilating means along at least a portion of said length, said two ventilating means providing for air circulation inside said chamber;

in combination with at least another locker comprising a back wall, a top wall, a bottom wall, a front wall and two side walls to form another chamber, the front wall of said other locker being provided with a door by which the user can have access to said other chamber, the front wall and the side walls of said other locker forming two lateral edges having a length, said side walls respectively provided with two ventilating means along at least a portion of said length, said lockers having one of said side walls and one of said ventilating means that are common;

wherein each of said ventilating means are constituted of a wire mesh and wherein each of said lateral vertical edges is provided along all of said length with one of said wire meshes; and wherein each said common wire mesh is an elongated member of U-shaped cross section having side sections facing respectively each of the two adjacent chambers, and having linking section interposed between the two adjacent front walls.

2. Lockers according to claim 1, wherein said common wire mesh is mechanically connected to the common side wall by means of a rigid element having a U-shaped rear side adapted to receive an edge of the common side wall and a front side provided with lateral recesses adapted to receive respectively edges of the common wire mesh.

3. Lockers according to claim 2, wherein said rigid element is provided with a lateral recess by which a locking member can be fixed onto said rigid element to cooperate with a locking device fixed on the corresponding door.

4. Locker according to claim 1, wherein all of said walls are made of plastic laminated panels.

5. Locker according to claim 1, wherein each of said wire meshes is made of cold laminated steel, of galvanized steel or stainless steel.

* * * * *